US009132648B2

(12) United States Patent
Fernando et al.

(10) Patent No.: US 9,132,648 B2
(45) Date of Patent: Sep. 15, 2015

(54) FLUID CARTRIDGE LABEL STIFFENER

(71) Applicants: Dilan N. Fernando, Thornton, CO (US); David M. Price, Loveland, CO (US); Ryan W. Ransburg, Boulder, CO (US); Sean K. Fitzsimons, Thornton, CO (US); Spencer R. Wasilewski, Highstown, NJ (US)

(72) Inventors: Dilan N. Fernando, Thornton, CO (US); David M. Price, Loveland, CO (US); Ryan W. Ransburg, Boulder, CO (US); Sean K. Fitzsimons, Thornton, CO (US); Spencer R. Wasilewski, Highstown, NJ (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/183,745

(22) Filed: Feb. 19, 2014

(65) Prior Publication Data

US 2015/0231890 A1 Aug. 20, 2015

(51) Int. Cl.
*B41J 2/175* (2006.01)

(52) U.S. Cl.
CPC ..... *B41J 2/17513* (2013.01); *B41J 2/17503* (2013.01); *B41J 2/17553* (2013.01); *B41J 2/17556* (2013.01); *B41J 2002/17516* (2013.01)

(58) Field of Classification Search
CPC ..... B41J 2002/17516; B41J 2/17553; B41J 2/17556; B41J 2/17513
See application file for complete search history.

(56) References Cited

U.S. PATENT DOCUMENTS

| | | | | |
|---|---|---|---|---|
| 5,666,146 | A | 9/1997 | Mochizuki et al. | |
| 5,682,191 | A * | 10/1997 | Barrett et al. | 347/104 |
| 5,691,755 | A | 11/1997 | Pawlowski, Jr. et al. | |
| 5,960,993 | A | 10/1999 | Mitsui et al. | |
| 6,158,620 | A | 12/2000 | Polan | |
| 6,164,743 | A | 12/2000 | Hmelar et al. | |
| 6,827,237 | B2 | 12/2004 | Yorn et al. | |
| 8,064,807 | B2 | 11/2011 | Koeda et al. | |
| 2003/0205583 | A1 | 11/2003 | Provenza | |
| 2007/0122204 | A1 | 5/2007 | Kita | |
| 2009/0207218 | A1 * | 8/2009 | Kimura | 347/86 |

* cited by examiner

*Primary Examiner* — Lisa M Solomon
(74) *Attorney, Agent, or Firm* — Blakely, Sokoloff, Taylor & Zafman LLP

(57) ABSTRACT

An apparatus is disclosed. The apparatus includes a fluid cartridge and a label stiffener applied to the fluid cartridge to provide stiffness to enable fluid within the fluid cartridge to empty under pressure.

10 Claims, 3 Drawing Sheets

FLUID CARTRIDGE LABEL STIFFENER

FIELD OF THE INVENTION

The invention relates to an ink cartridge used in an ink jet printer.

BACKGROUND

High speed production ink jet printers typically implement a fluid cartridge (or ink bag). Such a cartridge employs a flexible casing that is deformable in accordance with consumption of ink therein. However, fluid cartridges tend not to empty fully when external air pressure is applied. This is mainly due to wrinkles forming on the creases of the side walls that do not flatten out as the bag empties, thus trapping fluid when emptying.

Accordingly, a mechanism to enable full emptying of a fluid cartridge is desired.

SUMMARY

In one embodiment, an apparatus is disclosed. The apparatus includes a fluid cartridge and a label stiffener applied to the fluid cartridge to provide stiffness to enable fluid within the fluid cartridge to empty under pressure

BRIEF DESCRIPTION OF THE DRAWINGS

A better understanding of the present invention can be obtained from the following detailed description in conjunction with the following drawings, in which.

DETAILED DESCRIPTION

A fluid cartridge label stiffener is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
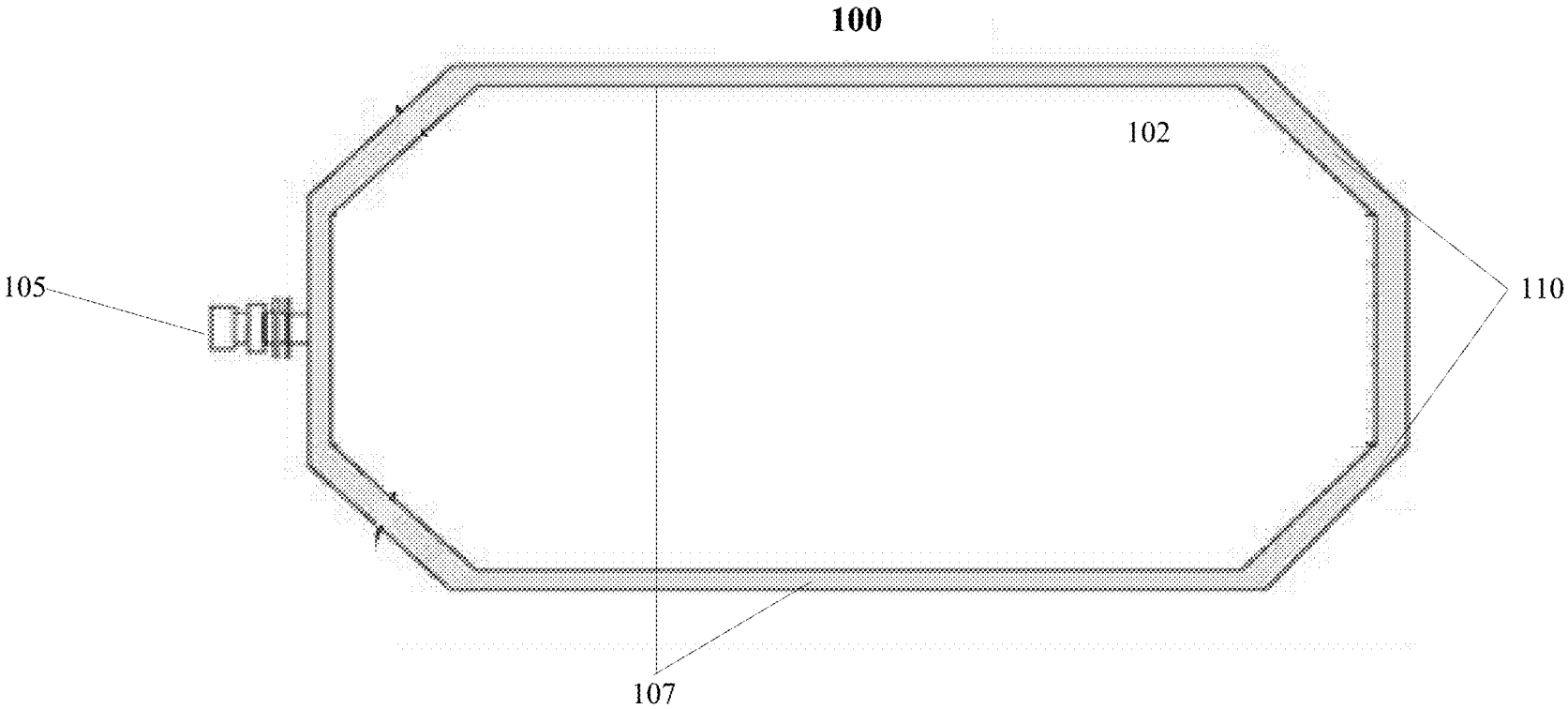
FIG. 1 illustrates a top view of one embodiment of a fluid cartridge.

FIG. 1 illustrates a top view of one embodiment of a fluid cartridge 100. In one embodiment, fluid cartridge 100 includes a bag body 102 formed by flexible sheet members and configured in a manner, for example, that flexible sheet members such as gas-barrier laminate films each formed by depositing aluminum on a polyethylene film are overlapped, and heat welding seal is performed along the outer periphery of the overlapped sheet members to form a welded portion.

Fluid (e.g., ink used for printing) is stored within cartridge 100 and is discharged via a nozzle 105 at one end edge of body 102. In one embodiment, nozzle 105 is formed by a hard material, such as composite resin. Body 102 also includes sidewalls 107 and rear edges 110. As discussed above, bag body 102 often does not fully empty as intended, resulting in the trapping of fluid.

According to one embodiment, an external label implemented as a product information label is applied to each bag body 102 to stiffen the top and bottom surface of bag body 102. In such an embodiment, the external label is comprised of a polyester material and provides additional stiffness to enable fluid within bag body 102 to empty under pressure. However, other embodiments may implement any polymer based material.

Figures 2A, 2B, 2C:
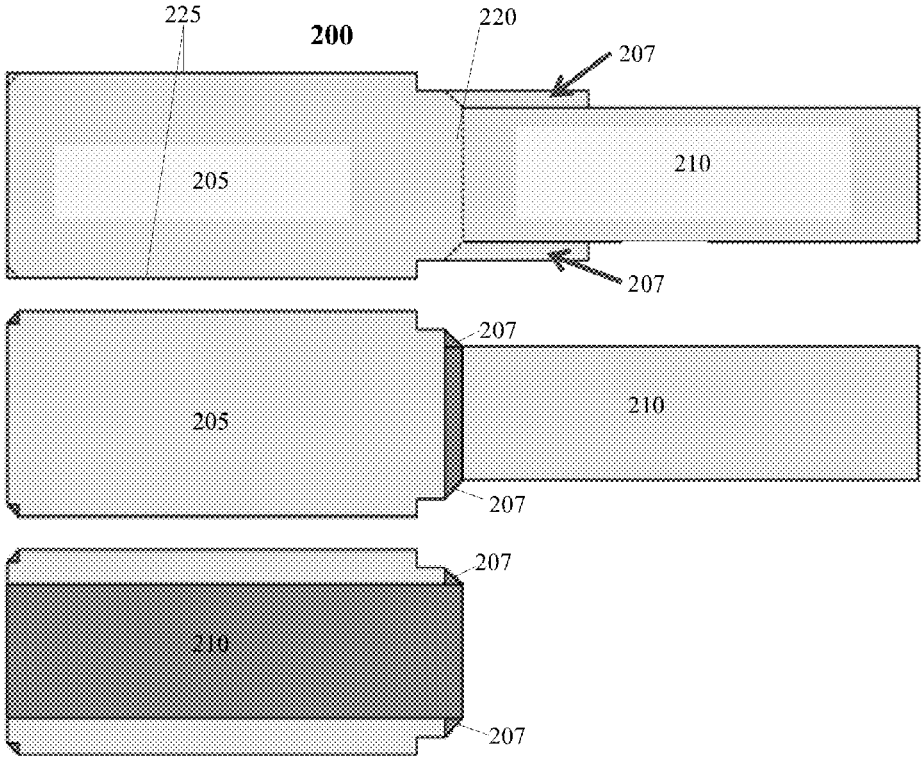
FIG. 2A-2C illustrate embodiments of a label stiffener.

FIG. 2A-2C illustrate embodiments of a label stiffener 200. FIG. 2A illustrates a top view of stiffener 200 that includes a top section 205 that is applied to a top wall of bag body 102 and a bottom section 210 that is applied to a bottom wall of bag body 102. Top section 205 and bottom section 210 provides reinforcement to bag body 102 to prevent the top and bottom walls, respectively, from undesirable deformation. Accordingly, top section 205 and bottom section 210 of stiffener 200 ensures that bag body 102 empties fully under pressure. In one embodiment, bottom section 210 does not fully cover the entire bottom wall of bag body 102 since the weight of the fluid provides force to stiffen the surface of the bottom wall while fluid is drained from bag body 102.

According to one embodiment, top section 205 includes sides 225 that may be expanded to wrap around top sidewalls 107 of bag body 102 in embodiments where additional reinforcement of the edges is required. Stiffener 200 also includes strands 207 that are implemented to wrap around edges 110 of bag body 102. According to one embodiment, strands 207 perform reinforce spot welds of edges 110 when wrapped around bag body 102. Folds 220 are also included to enable folding of strands 207 and bottom section 210 around bag body 102.

Figure 3:
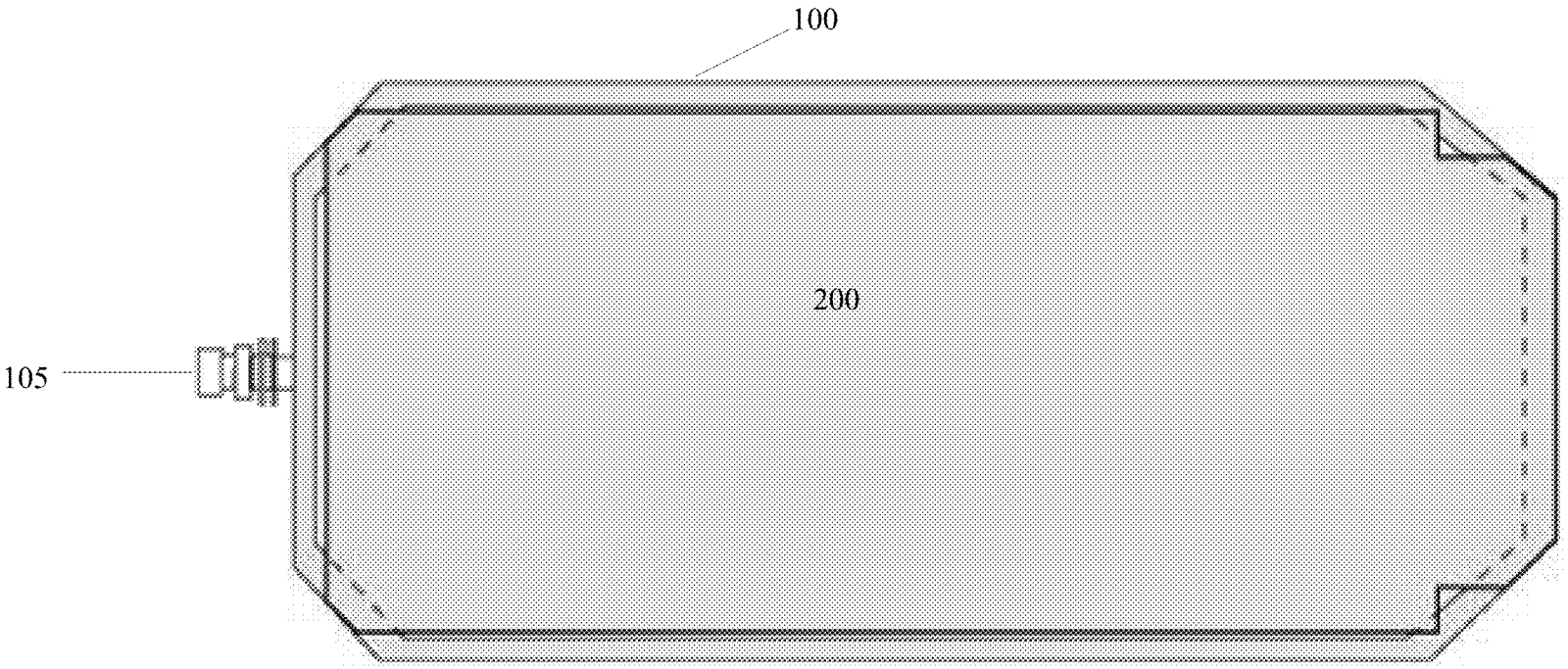
FIG. 3 illustrates one embodiment of a label stiffener applied to a fluid cartridge.

FIG. 2B illustrates the top view of an embodiment of label stiffener 200 in which strands 207 are wrapped around edges 110 of bag body 102, while FIG. 2C illustrates an embodiment of a bottom view showing label stiffener 200 once bottom section 210 has been folded and applied to bag body 102 (not shown in FIG. 2B). FIG. 3 illustrates a top view of one embodiment of label stiffener 200 applied to bag body 102.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

What is claimed is:

1. An apparatus comprising:

a fluid cartridge having a flexible bag body to store a fluid, including:
- a top wall;
- sidewalls;
- a bottom wall; and
- rear edges; and a label stiffener applied to the fluid cartridge to provide stiffness to enable fluid within the fluid cartridge to empty under pressure, the label stiffener comprising:
- a top section that is applied to the top wall of the bag body;
- a bottom section that is applied to the bottom wall of the bag body; and strands to wrap around and provide reinforcement of the rear edges.

2. The apparatus of claim 1 wherein the fluid cartridge further comprises:

a nozzle to discharge the fluid.

3. The apparatus of claim 1 wherein the bottom section does not fully cover the entire bottom wall of the bag body.

4. The apparatus of claim 1 wherein the top section of the label stiffener is expanded to wrap around the sidewalls of the bag body to provide additional reinforcement of the side edges.

5. The apparatus of claim 1 wherein label stiffener is implemented as a product information label is applied.

6. A label stiffener comprising:

a top section that is applied to provide stiffness to a top wall of a fluid cartridge bag body;

a bottom section that is applied to provide stiffness to a bottom wall of the fluid cartridge bag body; and strands to wrap around and provide reinforcement of rear edges of the fluid cartridge bag body.

7. The label stiffener of claim 6 wherein the label stiffener enables fluid within the fluid cartridge to empty under pressure applied to the bag body.

8. The label stiffener of claim 7 wherein the bottom section does not fully cover the entire bottom wall of the bag body.

9. The label stiffener of claim 6 wherein the top section of the label stiffener is expanded to wrap around the sidewalls of the bag body to provide additional reinforcement of the side edges.

10. The label stiffener of claim 6 wherein label stiffener is implemented as a product information label is applied.

* * * * *